US005976443A

United States Patent [19]

Nesbitt et al.

[11] Patent Number: 5,976,443

[45] **Date of Patent: *Nov. 2, 1999**

[54] GOLF BALL

[75] Inventors: R. Dennis Nesbitt, Westfield; Michael J. Sullivan, Chicopee, both of Mass.; Terence Melvin, Somers, Conn.

[73] Assignee: Lisco, Inc., Tampa, Fla.

[ * ] Notice: This patent is subject to a terminal disclaimer.

[21] Appl. No.: 08/729,725

[22] Filed: Oct. 7, 1996

Related U.S. Application Data

[62] Division of application No. 08/551,255, Oct. 31, 1995, Pat. No. 5,733,206.

[51] Int. Cl.[6] ..... B29C 39/10; B29C 35/04

[52] U.S. Cl. ..... 264/250; 264/265; 264/322; 425/144

[58] Field of Search ..... 264/265, 322, 264/327, 250; 425/143, 144

[56] References Cited

U.S. PATENT DOCUMENTS

| | | | |
|---|---|---|---|
| 684,050 | 10/1901 | Falconnet et al. | 264/327 |
| 2,618,812 | 11/1952 | Hulswit, Jr. et al. | 264/327 |
| 2,642,627 | 6/1953 | Mann et al. | 264/327 |
| 4,650,193 | 3/1987 | Molitor et al. | 273/328 |

*Primary Examiner*—Jan H. Silbaugh
*Assistant Examiner*—Edmund H. Lee
*Attorney, Agent, or Firm*—Fay, Sharpe, Beall, Fagan, Minnich & McKee

[57] ABSTRACT

The present invention is directed to molded golf ball core constructions and methods for improving the molded golf ball core construction. The molded golf ball comprises a molded spherical core having a soft skin integral therewith, and a cover molded over the core. The soft skin is formed by controlling exothermic molding temperatures. A slug is placed in a mold cavity which is then closed. A steam set point is set, and steam is applied for a 25–30 minute period such that a maximum mold temperature exceeds the steam set point. In the alternative, the core surface may be softened by first immersing a slug in water prior to subjecting the slug to conventional molding conditions.

5 Claims, 1 Drawing Sheet

GOLF BALL

This is a divisional of application Ser. No. 08/551,255 filed on Oct. 31, 1995, now U.S. Pat. No. 5,733,206.

BACKGROUND OF THE INVENTION

The present invention is directed to improvements in molded golf ball construction and more particularly to improvements in molded golf ball core construction. The improved core is useful in producing balls having, among other things, superior sound and feel as well as enhanced playability characteristics. The present invention is also directed to the novel methods used in constructing the core and to golf balls produced utilizing the improved core construction.

Sound and feel are two qualities of golf balls which are typically judged subjectively. For the most part, however, soft sound ("click") and soft feel (i.e., low vibrations) are golf ball qualities desired by many golfers. If a soft feeling ball is mis-hit, the sting in the hands is not as great as if a harder feeling ball is hit improperly. A soft sounding ball has a soft low pitch when hit with any club, but particularly off a putter.

One way to achieve a soft sound and feel is to provide a softened layer between the core and the cover. The prior art teaches development of a three piece ball or a multi-layer cover. However, adding additional layers is costly and can sometimes lead to non-uniform layers.

The Molitor, et al. U.S. Pat. No. 4,650,193 describes a two-piece golf ball comprising a core and a cover. The core has a central portion of a cross-linked, hard, resilient material and a soft, deformable outer layer. The cover is a conventional cover. The soft, deformable outer layer of the core is integral with the core. It is formed by treating a slug of an elastomeric material with a cure altering agent, namely elemental powdered sulfur, so that a thin layer of sulfur coats the surface. The sulfur-coated slug is then cured in a molding cavity at temperatures greater than 290° F., e.g., 325° F., for 10–20 minutes, depending on core temperature.

According to the '193 patent, sulfur on the surface of the slug penetrates a surface layer to a depth of about 1/16 inch during curing. Wherever the core is exposed to sulfur, the conventional peroxide cure is altered, resulting in an amorphous soft outer layer. The portion of the core that is not touched by the sulfur cures normally and becomes relatively crystalline. The end result is a spherical core having a hardness gradient in its surface layers.

The present inventors seek to achieve somewhat of a similar effect using methods which do not require the addition of elemental sulfur to modify and soften the core surface such that the cure on the core surface is retarded. At the same time, the inventors seek to maintain the parameters of resilience and hardness of the finished ball at desired levels.

Resilience is determined by the coefficient of restitution (C.O.R.), the constant "e", which is the ratio of the relative velocity of two elastic spheres after direct impact to that before impact, or more generally, the ratio of the outgoing velocity to incoming velocity of a rebounding ball. As a result, the coefficient of restitution (i.e. "e") can vary from zero to one, with one being equivalent to an elastic collision and zero being equivalent to an inelastic collision. Hardness is determined as the deformation (i.e. Riehle compression) of the ball under a fixed load of 200 pounds applied across the ball's diameter (i.e. the lower the compression value, the harder the material).

Resilience (C.O.R.), along with additional factors such as clubhead speed, angle of trajectory, and ball configuration (i.e. dimple pattern), generally determines the distance a ball will travel when hit. Since clubhead speed and the angle of trajectory are not factors easily controllable, particularly by golf ball manufacturers, the factors of concern among manufacturers are the coefficient of restitution (C.O.R.) and the surface configuration of the ball.

In this regard, the coefficient of restitution of a golf ball is generally measured by propelling a ball at a given speed against a hard surface and measuring the ball's incoming and outgoing velocity electronically. The coefficient of restitution must be carefully controlled in all commercial golf balls in order for the ball to be within the specifications regulated by the United States Golfers Association (U.S.G.A.).

Along this line, the U.S.G.A. standards indicate that a "regulation" ball cannot have an initial velocity (i.e. the speed off the club) exceeding 255 feet per second (250 feet per second with a 2% tolerance). Since the coefficient of restitution of a ball is related to the ball's initial velocity (i.e. as the C.O.R. of a ball is increased, the ball's initial velocity will also increase), it is highly desirable to produce a ball having a sufficiently high coefficient of restitution to closely approach the U.S.G.A. limit on initial velocity, while having an ample degree of hardness (i.e. impact resistance) to produce enhanced durability.

The coefficient of restitution (C.O.R.) in solid core balls is a function of the composition of the molded core and of the cover. In balls containing a wound core (i.e. balls comprising a liquid or solid center, elastic windings, and a cover), the coefficient of restitution is a function of not only the composition of the center and cover, but also the composition and tension of the elastomeric windings.

An object of this invention is to develop a method for improving the sound and feel of a golf ball without adversely affecting the resilience or coefficient of restitution of the ball. The method does not require the addition of sulfur based chemicals to an uncured slug, in order to minimize the steps involved. In addition, the softer golf ball produces the playability characteristics desired by the more skilled golfer. It also enhances durability characteristics, as the outer skin is flexible and resists crack propagation.

These and other objects and features of the invention will be apparent from the following summary and description of the invention and from the claims.

SUMMARY OF THE INVENTION

Typically, cores or one piece balls are molded at very high temperatures (in the range of 295° F. or higher) for very short periods of time (i.e. 10–20 minutes). The resulting cores have a hard surface with a softer inner core. This is due to the high temperature exotherm degrading and softening of the inner core. The inventors have found that by molding the cores at somewhat lower temperatures (i.e. lower than 295° F.) for increased durations (i.e. times greater than 20 minutes), cores having softened surfaces are produced. The inventors have also learned that exposing the cores to water prior to the conventional curing steps likewise softens the core surface. The soft skin embodied on the core is durable and resists crack propagation, a useful feature for one piece balls.

The present inventors have developed novel methods for producing a golf ball having a spherical core which includes a central portion and surface or skin portion. The central portion is harder than the surface portion. The hardness of the central portion ranges from about 50 to 90 Shore C, and the hardness of the integral skin is in the range of about 30–70 Shore C. The skin comprises the radially outermost 1/32 inch to ¼ inch of the spherical core. A conventional cover (i.e. comprised of ionomers, urethane, balata, or other elastomer-based cover materials) is then molded over the spherical core.

In one embodiment of the invention, the outer surface of a slug is softer than the central portion of the slug to a depth of up to ¼ inch by controlling molding temperatures. The raw slug is placed in a mold cavity which is closed using 500 psi pressure. A steam set point is fixed, and steam is applied for a predetermined time period in the range of 25–30 minutes. A maximum mold temperature in excess of the steam set point temperature is achieved. A conventional cover is then molded over the core.

Another related but novel embodiment entails the process of immersing a slug in water prior to molding the core. Water is absorbed into the surface of the slug. The slug is subsequently molded by heating it to a sufficient molding temperature for a predetermined period of time to form a core. The softened skin is up to ¼" in thickness. A cover is subsequently molded over the core to form a golf ball.

An advantage of the present invention is that the methods allow for usage of existing molding equipment to achieve the softened skin more economically. Extraneous chemicals need not be purchased. The step of coating the slug with elemental sulfur is eliminated. With respect to the exotherm method described herein, only the temperature and timing need be adjusted. Only water and an optional surfactant need to be added for the second embodiment.

The two piece construction used in preparing golf balls in accordance with the present invention is advantageous over three piece balls. There are fewer steps involved and the resulting soft skin is more uniform.

The methods disclosed herein can also be used in constructing one piece balls wherein the soft outer skin encompasses a harder inner core. The soft outer skin offers increased durability as the soft outer skin is flexible and resists crack propagation. Improved spin and control are also realized from the one piece construction.

These and other advantages of the invention will become apparent from the detailed description provided below.

BRIEF DESCRIPTION OF THE DRAWING

The present invention is further described and illustrated in the accompanying drawing which forms a part hereof.

DETAILED DESCRIPTION OF THE INVENTION

Figure 1:
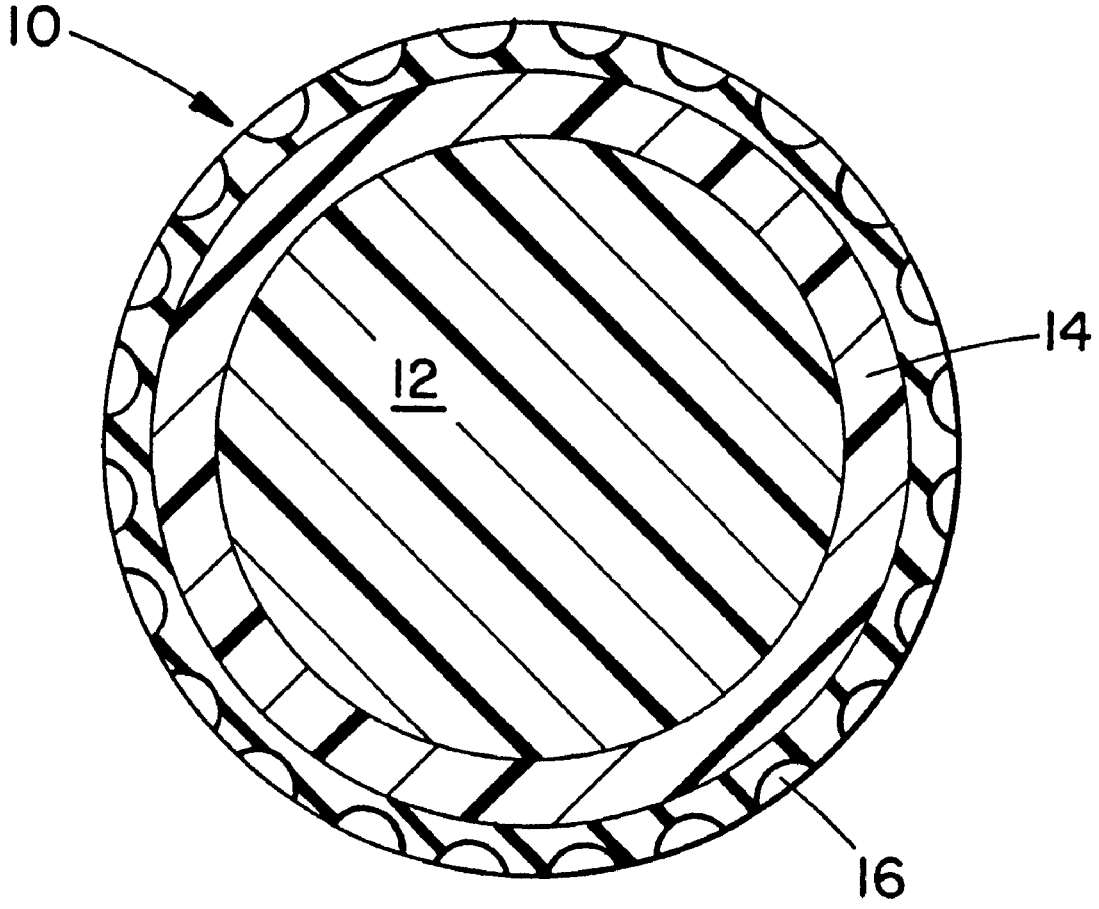
FIG. 1 is a schematic cross section of a golf ball in accordance with the present invention, the schematic illustrating the hardness of various regions of the colf ball.

The present invention is directed to improved core construction and several methods for improving core construction.

Broadly, the golf ball core of the invention consists of a spherical central portion which is hard and resilient and which may be formed by molding conventional core formulations. A soft, relatively easily deformed outer layer or skin is embodied or integral with the central portion.

Conventional solid cores are typically compression or injection molded from a slug of uncured elastomer composition comprising at least polybutadiene and a metal salt of an alpha, beta, ethylinically unsaturated monocarboxylic acid. Metal oxide or other fillers, such as barytes may also be included to increase core weight so that the finished ball more closely approaches the U.S.G.A. upper weight limit of 1.620 ounces.

More specifically, the core compositions and resulting molded golf balls of the present invention are manufactured using conventional ingredients and blending techniques. In this regard, the core compositions of the invention may be based on polybutadiene, and mixtures of polybutadiene with other elastomers. It is preferred that the base elastomer have a relatively high molecular weight. The broad range for the molecular weight of suitable base elastomers is from about 50,000 to about 500,000. A more preferred range for the molecular weight of the base elastomer is from about 100,000 to about 500,000. As a base elastomer for the core composition, cis-polybutadiene is preferably employed, or a blend of cis-polybutadiene with other elastomers may also be utilized. Most preferably, cis-polybutadiene having a weight-average molecular weight of from about 100,000 to about 500,000 is employed. Along this line, it has been found that the high cis-polybutadiene manufactured and sold by Shell Chemical Co., Houston, Tex., under the trade name Cariflex BR-1220 is particularly well suited.

The unsaturated carboxylic acid component of the core composition (a co-cross-linking agent) is the reaction product of the selected carboxylic acid or acids and an oxide or carbonate of a metal such as zinc, magnesium, barium, calcium, lithium, sodium, potassium, cadmium, lead, tin, and the like. Preferably, the oxides of polyvalent metals such as zinc, magnesium and cadmium are used, and most preferably, the oxide is zinc oxide.

Exemplary of the unsaturated carboxylic acids which find utility in the present core compositions are acrylic acid, methacrylic acid, itaconic acid, crotonic acid, sorbic acid, and the like, and mixtures thereof. Preferably, the acid component is either acrylic or methacrylic acid. Usually, from about 20 to about 50, and preferably from about 25 to about 35 parts by weight of the carboxylic acid salt, such as zinc diacrylate, is included in the core composition. The unsaturated carboxylic acids and metal salts thereof are generally soluble in the elastomeric base, or are readily dispersible.

The free radical initiator included in the core composition is any known polymerization initiator (a co-cross-linking agent) which decomposes during the cure cycle. The term "free radical initiator" as used herein refers to a chemical which, when added to a mixture of the elastomeric blend and a metal salt of an unsaturated, carboxylic acid, promotes cross-linking of the elastomers by the metal salt of the unsaturated carboxylic acid. The amount of the selected initiator present is dictated only by the requirements of catalytic activity as a polymerization initiator. Suitable initiators include peroxides, persulfates, azo compounds and hydrazides. Peroxides which are readily commercially available are conveniently used in the present invention, generally in amounts of from about 0.1 to about 10.0 and preferably in amounts of from about 0.3 to about 3.0 parts by weight per each 100 parts of elastomer.

Exemplary of suitable peroxides for the purposes of the present invention are dicumyl peroxide, n-butyl 4,4'-bis (butylperoxy) valerate, 1,1-bis(t-butylperoxy)-3,3,5-trimethyl cyclohexane, di-t-butyl peroxide and 2,5-di-(t-butylperoxy)-2,5 dimethyl hexane and the like, as well as mixtures thereof. It will be understood that the total amount of initiators used will vary depending on the specific end product desired and the particular initiators employed.

Examples of such commercial available peroxides are Luperco 230 or 231 XL, a peroxyketal manufactured and sold by Atochem, Lucidol Division, Buffalo, N.Y., and Trigonox 17/40 ir 29/40, a1, 1-di-(t-butylperoxy)-3,3,5-trimethyl cyclohexane sold by Akzo Chemie America, Chicago, Ill. The one hour half life of Luperco 231 XL is about 112° C., and the one hour half life of Trigonox 29/40 is about 129° C.

The core compositions of the present invention may additionally contain any other suitable and compatible modifying ingredients including, but not limited to, metal oxides, fatty acids, and diisocyanates. For example, Papi 94, a polymeric diisocyanate, commonly available from Dow Chemical Co., Midland, Mich., is an optional component in the rubber compositions. It can range from about 0 to 5 parts by weight per 100 parts by weight rubber (phr) component, and acts as a moisture scavenger.

Various activators may also be included in the compositions of the present invention. For example, zinc oxide and/or magnesium oxide are activators for the polybutadiene. The activator can range from about 2 to about 30 parts by weight per 100 parts by weight of the rubbers (phr) component.

Moreover, filler-reinforcement agents may be added to the composition of the present invention. Since the specific gravity of polypropylene powder is very low, and when compounded, the polypropylene powder produces a lighter molded core, large amounts of higher gravity fillers may be added. Additional benefits may be obtained by the incorporation of relatively large amounts of higher specific gravity, inexpensive mineral fillers such as calcium carbonate. Such fillers as are incorporated into the core compositions should be in finely divided form, as for example, in a size generally less than about 30 mesh and preferably less than about 100 mesh U.S. standard size. The amount of additional filler included in the core composition is primarily dictated by weight restrictions and preferably is included in amounts of from about 10 to about 100 parts by weight per 100 parts rubber.

The preferred fillers are relatively inexpensive and heavy and serve to lower the cost of the ball and to increase the weight of the ball to closely approach the U.S.G.A. weight limit of 1.620 ounces. Exemplary fillers include mineral fillers such as limestone, silica, mica barytes, calcium carbonate, or clays. Limestone is ground calcium/magnesium carbonate and is used because it is an inexpensive, heavy filler.

As indicated, ground flash filler may be incorporated and is preferably 20 mesh ground up center stock from the excess flash from compression molding. It lowers the cost and may increase the hardness of the ball.

Fatty acids may also be included in the compositions, functioning to improve moldability and processing. Generally, free fatty acids having from about 10 to about 40 carbon atoms, and preferably having from about 15 to about 20 carbon atoms, are used. Exemplary of suitable fatty acids are stearic acid and linoleic acids, as well as mixtures thereof. When included in the core compositions, the fatty acid component is present in amounts of from about 1 to about 15, preferably in amounts from about 2 to about 5 parts by weight based on 100 parts rubber (elastomer).

It is preferred that the core compositions include stearic acid as the fatty acid adjunct in an amount of from about 2 to about 5 parts by weight per 100 parts of rubber.

Diisocyanates may also be optionally included in the core compositions when utilized, the diioscyanates are included in amounts of from about 0.2 to about 5.0 parts by weight based on 100 parts rubber. Exemplary of suitable diisocyanates is 4,4'-diphenylmethane diisocyanate and other polyfunctional isocyanates know to the art.

Furthermore, the dialkyl tin difatty acids set forth in U.S. Pat. No. 4,844,471, the dispersing agents disclosed in U.S. Pat. No. 4,838,556, and the dithiocarbonates set forth in U.S. Pat. No. 4,852,884 may also be incorporated into the polybutadiene compositions of the core. The specific types and amounts of such additives are set forth in the above identified patents, which are incorporated herein by reference.

The golf ball core compositions of the invention are generally comprised of the addition of about 1 to about 100 parts by weight of particulate polypropylene resin (preferably about 10 to about 100 parts by weight polypropylene powder resin) to core compositions comprised of 100 parts by weight of a base elastomer (or rubber) selected from polybutadiene and mixtures of polybutadiene with other elastomers, 20 to 50 parts by weight of at least one metallic salt of an unsaturated carboxylic acid, and 1 to 10 parts by weight of a free radical initiator. More preferably, the particulate polypropylene resin utilized in the present invention comprises from about 20 to about 40 parts by weight of a polypropylene powder resin such as that trademarked and sold by Amoco Chemical Co. under the designation "6400 P", "7000 P" and "7200 P". The ratios of the ingredients may vary and are best optimized empirically.

As indicated above, additional suitable and compatible modifying agents such as fatty acids, and secondary additives such as Pecan shell flour, ground flash (i.e. grindings from previously manufactured cores of substantially identical construction), barium sulfate, zinc oxide, etc. may be added to the core compositions to increase the weight of the ball as necessary in order to have the ball reach or closely approach the U.S.G.A. weight limit of 1.620 ounces.

In producing golf ball cores utilizing the present compositions, the ingredients may be intimately mixed using, for example, two roll mills or a Banbury mixer until the composition is uniform, usually over a period of from about 5 to about 20 minutes. The sequence of addition of components is not critical. A preferred blending sequence is as follows.

The elastomer, polypropylene powder resin, fillers, zinc salt, metal oxide, fatty acid, and the metallic dithiocarbamate (if desired), surfactant (if desired), and tin difatty acid (if desired), are blended for about 7 minutes in an internal mixer such as a Banbury mixer. As a result of shear during mixing, the temperature rises to about 200° F. The initiator and diisocyanate are then added and the mixing continued until the temperature reaches about 220° F. whereupon the batch is discharged onto a two roll mill, mixed for about one minute and sheeted out.

The sheet is then rolled into a "pig" placed in a Barwell preformer and slugs are produced. The mixing is desirably conducted in such a manner that the composition does not reach incipient polymerization temperatures during the blending of the various components.

The conventional slugs or cores prepared substantially as described above are then treated using novel techniques so that the outer 1/32" to 1/4" periphery of each slug or core is softened. The softened periphery is referred to as a soft skin. This skin is embodied in or integral with the preexisting core or slug. It is not the result of adding a layer. The slug itself is treated to soften the outermost periphery in order to achieve a golf ball which, when a cover is placed over the soft-skinned core, has superior sound and feel. Sound and feel are subjective parameters. However, in general, a soft sound has a softer, lower pitch sound when hit with any club but particularly off a putter. The same applies for a soft feel. A hard feeling ball will sting in the hands when hit with a driver, particularly when hit improperly. A soft feeling putt will be barely audible.

The present inventors have developed a novel method for achieving a soft skin integral with or embodied in a polymeric core that calls for controlling the molding conditions of the slug. More specifically, the exothermic reaction in molding the core is regulated such that the interior of the resulting core is hard due to higher exothermic temperatures, and the outer skin is soft because of lower outside mold temperatures.

The exothermic method involves placing a slug or preform weighing approximately 44 grams into a cold 1.600" cavity (i.e. a four cavity lab mold). The four cavity compression mold is closed using 500 psi hydraulic ram pressure. The steam temperature is set at a predetermined temperature and the steam is turned on for a predetermined period of time. As the curing time progresses, the steam temperature overrides the steam set point and reaches a mold temperature at the end of the predetermined time. The steam is then turned off and cold water is applied for approximately 15 minutes. The mold is opened and centers are removed. The molded cores have a soft skin which is embodied with the central core.

Another method for forming a soft skin on a preform or slug calls for first immersing the slug into water. Water has a deleterious effect on the properties of conventional core formulations. Water, even in very small quantities, will soften the compression of the core by retarding cross-linking on the core surface during molding. A slug can be immersed into water prior to molding the core to absorb surface moisture and create a soft skin on the outside of the core. Immersion of slugs in water with a surfactant (to increase wetting and penetration) for a period of two hours softens the core surface. A suitable surfactant is one which is soluble in water and which acts to lower the surface tension. An example of a surfactant which may be used in the present method is one such as Fluorad FC-120 made by the 3M Company.

In the alternative, the cure on the core surface can be chemically retarded by coating the outside of the preform or slug with a chemical that retards the cure or cross-linking of a peroxide system prior to molding the center. Coating with elemental sulfur was described in U.S. Pat. No. 4,650,193. Other chemicals which can be used for retarding cross-linking during molding include sulphur bearing accelerators for rubber vulcanization such as Altax (benzothiazyl disulf ide), Captax (2-mercaptobenzothiazole) manufactured by R. T. Vanderbilt Co. Inc., Norwalk, Conn. and antioxidant chemicals such as Aqerite White (dibetanaphthyl-p-phenylenediamine) from R. T. Vanderbilt and Irganox 1520 (2, 4-Bis [Octylithio] methyl)-o-cresol from Ciba-geigey, Hawthorne, N.Y.

The above described methods for softening the outer skin on the cores result in a skin softened core. The core that is treated by any of the above methods has a diameter in a range of about 1.480 inches to 1.600 inches, preferably 1.500 inches to 1.580 inches. The resulting skin thickness is in a range of about 1/32 of an inch to 1/4 inch, preferably 1/16 inch to 1/8 inch. The resulting core hardness is in the Shore C range of 50–90, preferably 60–80 Shore C. As for the skin, its hardness is in the range of 30–70 Shore C and preferably 50–60 Shore C.

After molding, the core is removed from the mold and the surface thereof, preferably treated to facilitate adhesion thereof to the covering materials. Surface treatment can be effected by any of the several techniques known in the art, such as corona discharge, ozone treatment, sand blasting, and the like. Preferably, surface treatment is effected by grinding with an abrasive wheel.

The core is subsequently converted into a golf ball by providing at least one layer of covering material thereon, ranging in thickness from about 0.040 to about 0.120 inch and preferably from about 0.055 to about 0.090 inch. The cover hardness, when measured on a Shore D scale, is in the range of 45 to 75 preferably 50–70 Shore D. The cover composition preferably is made from ethylene-acrylic acid or ethylene-methacrylic acid copolymers neutralized with mono or polyvalent metals such as sodium, potassium, lithium, calcium, zinc, or magnesium.

The ionic copolymers used to produce the cover compositions may be made according to known procedures, such as those in U.S. Pat. No. 3,421,766 or British Patent No. 963,380, with neutralization effected according to procedures disclosed in Canadian Patent No. 674,595 and 713, 631, wherein the ionomer is produced by copolymerizing the olefin and carboxylic acid to produce a copolymer having the acid units randomly distributed along the polymer chain. The ionic copolymer comprises one or more $\alpha$-olefins and from about 9 to about 30 weight percent of $\alpha$, $\beta$-ethylenically unsaturated mono- or dicarboxylic acid, the basic copolymer neutralized with metal ions to the extent desired.

At least 18% of the carboxylic acid groups of the copolymer are neutralized by the metal ions, such as sodium, potassium, zinc, calcium, magnesium, and the like, and exist in the ionic state.

Suitable olefins for use in preparing the ionomeric resins include, but are not limited to, ethylene, propylene, butene-1, hexene-1, and the like. Unsaturated carboxylic acids include, but are not limited to, acrylic, methacrylic, ethacrylic, $\alpha$-chloroacrylic, crotonic, maleic, fumaric, itaconic acids, and the like. Preferably, the ionomeric resin is a copolymer of ethylene with acrylic and/or methacrylic acid, such as those disclosed in U.S. Pat. Nos. 4,884,814; 4,911,451; 4,986,545 and 5,098,105, incorporated herein by reference.

In this regard, the ionomeric resins sold by E.I. DuPont de Nemours Company under the trademark "Surlyn®", and the ionomer resins sold by Exxon Corporation under either the trademark "Escor®" or the trade name "Iotek" are examples of commercially available ionomeric resins which may be utilized in the present invention. The ionomeric resins sold formerly under the designation "Escor®" and now under the new name "Iotek", are very similar to those sold under the "Surlyn®" trademark in that the "Iotek" ionomeric resins are available as sodium of zinc salts of poly(ethylene acrylic acid) and the "Surlyn" resins are available as zinc or sodium salts of poly(ethylene methacrylic acid). In addition various blends of "Iotek" and "Surlyn®" ionomeric resins, as well as other available ionomeric resins, may be utilized in the present invention.

In the embodiments of the invention that are set forth below in the Examples, the cover included acrylic acid ionomer resin having the following compositions:

| | % weight |
|---|---|
| Iotek 4000 (7030)[1] | 52.4 |
| Iotek 8000 (900)[2] | 45.3 |
| Unitane 0-110[3] | 2.25 |
| Ultramarine blue[4] | 0.0133 |
| Santonox R[5] | 0.0033 |

[1]Iotek 4000 is a zinc salt of poly (ethylene acrylic acid)
[2]Iotek 8000 is a sodium salt of poly (ethylene acrylic acid)
[3]Unitane 0-100 is a titanium dioxide sold by Kemira Inc., Savannah, GA.
[4]Ultramarine Blue is a pigment sold by Whitaker, Clark, and Daniels of South Painsfield, N.J.
[5]Santonox R is a antioxidant sold by Monsanto, St. Louis, MO.

The covered golf ball can be formed in any one of the several methods known to the art. For example, the molded core may be placed in the center of a golf ball mold and the ionomeric resin-containing cover composition injected into and retained in the space for a period of time at a mold temperature of from about 40° F. to about 120° F.

Alternatively, the cover composition may be injection molded at about 300° F. to about 450° F. into smooth-surfaced hemispherical shells, a core and two such shells placed in a dimpled golf ball mold and unified at temperatures on the order of from about 100° F. to about 200° F.

The golf ball produced is then painted (if desired) and marked, painting being effected by spraying techniques.

FIG. 1 shows a cross sectional view of a golf ball 10 made in accordance with the present invention. The golf ball core includes a central portion 12 having a hardness in a range of about 50–90 Shore C, and an integral surface portion 14 having a hardness in a range of about 30–70 Shore C. The surface portion 14 comprises the outermost 1/32 inch to 1/4 inch of the spherical core. A cover 16 is molded over the spherical molded core.

The present invention is further illustrated by the following examples in which the parts of the specific ingredients are by weight. It is to be understood that the present invention is not limited to the examples, and various changes and modifications may be made in the invention without departing from the spirit and scope thereof.

EXAMPLE 1–9

Standard Tour Edition™ (i.e. TE) lavender slugs or preforms weighing approximately 44 grams each and having the following composition were obtained:

| Component | Parts by Weight |
|---|---|
| Cariflex BR-1220 | 74.0 |
| Taktene 220 (Polybutadiene) | 26.0 |
| Zinc Oxide | 19.6 |
| T.G. Regrind | 8.8 |
| Zinc Stearate | 19.9 |
| ZDA (zinc diacrylate) | 27.1 |
| Color M.B. | .1 |
| Varox 230-XL (40% Peroxide) | 0.60 |
| Varox 130-XL (40% Peroxide) | 0.15 |
| | 176.25 |

Each slug had an oval shape approximately 10% larger than the center.

The exothermic reaction method described herein was conducted on the compression molded slugs. In each run, the slugs or preforms were placed into a cold 1.600 inch cavity of a four cavity lab mold or press. The four-cavity compression mold was hydraulically closed using 500 psi of ram pressure. The steam temperature was set at a predetermined steam set point and the steam was turned on for a predetermined steam time (around 15 minutes for the control, about 25–30 minutes for the remaining six slugs). The temperature overrode the set point and reached a mold temperature of higher than the set point at the end of the steam time. The steam was then turned off and cold water was applied for about 15 minutes. The mold was then opened and the cores were removed. The hardness was measured at the core center, midway from the center to the surface, and at the surface. It was found that the middle of the core is slightly softer than the midway measured hardness because of the very high exothermic temperatures which are applied. These temperatures degrade the core composition. The outer skin measurers much softer. This softness is due to the cooling effect of the mold cavity. Maximum cross-linking was not achieved along the surface as a result of the low mold temperature. In contrast, the mid-way point achieves maximum cross-linking and hardness as a result of the exothermic reaction and achieves maximum cross-linking and hardness.

The steps of the exothermic reaction were repeated on six different slugs having the above composition. The steam set point and steam time varied for each trial, thus ending with varying maximum mold temperatures. Also, a control slug was prepared according to a more conventional method of subjecting the slug to very high temperatures (e.g. 330° F.) for a shortened period of time (only 15 minutes). The experimental factors are identified in the following table:

| SLUG | BLOWDOWN (MIN.) | SET POINT (°F.) | STEAM TIME (MIN.) | WATER (MW.) | PSI (RAM) | MAXIMUM MOLD TEMPER. (°F.) |
|---|---|---|---|---|---|---|
| Control (C) | 2 | 330 | 15 | 15 | 500 | 331 |
| 1 | 2 | 230 | 25 | 15 | 500 | 280 |
| 2 | 2 | 220 | 25 | 15 | 500 | 266 |
| 3 | 2 | 210 | 25 | 15 | 500 | 262 |
| 4 | 2 | 210 | 30 | 15 | 500 | 253 |
| 5 | 2 | 200 | 30 | No cure | 500 | 215 |
| 6 | 2 | 210 | 27 | 15 | 500 | 230 |

The hardness of the cores was measured at varying diameters. The hardness in the middle of the cores, 80 Shore C, is softer than the midway measured of 85 Shore C due to the very high exothermic temperatures degrading the core composition. The outer skin of 50–60 Shore C is soft due to the cooling effect of the mold cavity and does not reach maximum cross-linking as a result of the low mold temperature. The middle of the center will exceed 350° F. due to the exothermic reaction and will achieve maximum cross-linking and hardness.

Slug no. 3 above showed a soft ring when cut in half. It was noted, however, that ring thickness was not completely uniform. The ring was thicker (i.e. about ¼ thick) at one pole and thinner (i.e. about ⅛" thick) at the opposite pole. This inconsistency is attributable to a difference in temperature between the bottom and top steam plates. It has been determined that uniform temperature control leads to a uniform skin thickness. Also, it was noted that the hardness at the very middle of molded slug no. 3 measured 80 Shore C, and the measurement roughly midway from the core center to its outer diameter measured at a hardness of 85 Shore C.

Slugs 5 and 6 did not provide desirable results as temperatures did not increase sufficiently. Temperatures were reduced and steam time was increased in an attempt to obtain a soft skin on the core. As will be noted, slug no. 5 achieved no cure as the mold temperature increased only to 215° F. Similarly, the mold temperature of slug no. 6 achieved only 230° F., and its Shore C hardness was substantially lower than the others.

EXAMPLE 7

A seventh slug of the above composition was prepared. Here, the slug was subjected to the water immersion method for developing a soft skin on a core. Slugs were immersed in water with a surfactant, in this case, Flurad FC-120. The surface moisture was blotted off and then the slug was subjected to molding with conditions likened to the control (C) above (i.e., the slugs were subjected to higher temperatures for shorter time periods). The slugs changed color on the surface to a grayish shade. The color change was only 1/32" deep.

The Shore C hardness was determined for all of the slugs tested above in Examples 1–7. These values are set forth in the following table:

| SLUG TYPE | SHORE C |
|---|---|
| C | 85 |
| 1 | 75–80 |
| 2 | 70–75 |
| 3 | 60–70 |
| 4 | 70–75 |
| 6 | 40–50 |
| 7 | 70–75 |

The above results support the findings that the exothermic method achieves a softer skin on the slugs as compared to the control slug molded according to conventional methods.

Slugs immersed in water with a surfactant for two hours (i.e. slug 7, example 7) were molded the same as the control slugs (i.e. the control slugs were not immersed in water) and the following properties were determined for comparison:

| | CONTROL (C) | WATER IMMERSED (EXAMPLE 7) |
|---|---|---|
| Size (inches): | 1.572 | 1.570 |
| Weight (grams): | 38.2 | 38.2 |
| Riehle Compression: | 62 | 67 |
| COR: | .806 | .805 |
| Surface Hardness (Shore C) | 85 | 70–75 |

As shown above, the core molded from a slug immersed in water was 5 points softer in compression than the control and had a Shore C surface hardness at least 5 points softer than the control. The core molded from the immersed slug when cut in half showed a change in color indicating the soft surface skin. This soft skin was approximately 1/32 deep.

Longer immersion times increase the thickness of the soft skin and soften the core compression further.

Next, the control slug and several of the various slug types (identified as 1, 2, 3, 4 and 7) were tested to ascertain their respective sizes, weights, Riehle compressions and coefficients of restitution. The results for the cores are tabulated as follows:

| SLUG TYPE | SIZE (IN.) | WEIGHT (GM.) | RIEHLE COMPRESSION | C.O.R. (e) |
|---|---|---|---|---|
| (C) | 1.572 | 38.2 | 62 | .806 |
| 1 | 1.570 | 38.0 | 63 | .808 |
| 2 | 1.570 | 38.0 | 65 | .805 |
| 3 | 1.572 | 37.8 | 91 | .793 |
| 4 | 1.570 | 38.1 | 66 | .783 |
| 7 | 1.570 | 38.2 | 67 | .805 |

EXAMPLE 8

Yellow production Top-Flite Tour Z-Balata 90 slugs comprising the following composition were immersed in water and a surfactant for 67 hours:

| Component | Phr |
|---|---|
| Cariflex BR-1220 | 73.0 |
| Taketene 220 | 27.0 |
| Zinc Oxide | 22.3 |
| T.G. Regrind | 10.0 |
| Zinc Stearate | 20.0 |
| ZDA | 26.0 |
| Color M.B. | .1 |
| 231-XL | 0.9 |
| | 179.3 |

The surfactant used in this instance was Fluorad FC-120. After immersing the slugs in water and a surfactant for 67 hours, the slugs were removed and blotted dry. They were then molded with the same conditions as the control slugs, i.e. for 15 minutes at a 330° F. steam set point.

EXAMPLE9

The slugs were prepared as in Example 8 but air dried for 24 hours before molding. The soft skin was only about 1/16" deep. The following comparative results were obtained:

| SLUG | COMPRESSION | COR |
|---|---|---|
| Control (C) | .070 | .800 |
| 9 | .081 | .782 |

The control center had a Riehle compression of 0.070" and the center made from a slug immersed 67 hours in water had a Riehle compression of 0.081". This is 0.011" points softer than the control due to the soft skin. In other words, the soft skin made the center compression 11 points softer compression. The COR, however, is 18 points slower than the control. This is expected, as balls with softer compressions normally have a lower COR than balls or cores having harder compressions.

The invention has been described with reference to the preferred embodiments. Obviously, modifications and alterations will occur to others upon reading and understanding the preceding detailed description. It is intended that the invention be construed as including all such alterations and modifications insofar as they come within the scope of the claims and the equivalents thereof.

We claim:

1. A method for molding golf balls, wherein said golf balls comprise a spherical molded core including a central portion having a hardness in a range of about 50–90 Shore C and an outer surface portion having a hardness in a range of about 50–70 Shore C, the surface portion integral with the central portion and comprising the radially outmost 1/32 inch to 1/4 inch of the spherical core and a cover molded over the spherical molded core, the method comprising the steps of:

softening the outer surface of a slug, said slug to be used as a center for a golf ball, wherein the softening is to a depth of up to 1/4 inch by controlling molding temperatures, thereby producing a spherical core having a soft integral outer surface; and molding a cover over the soft integral outer surface of the spherical core.

2. A method for molding golf balls according to claim 1, wherein the softening step comprises:

a) placing the slug in a cavity of a mold b) closing the mold;

c) setting a steam set point;

d) applying steam for a predetermined time period; and e) achieving a maximum mold temperature, said maximum mold temperature being in excess of the steam set point.

3. A method for molding golf balls, according to claim 2, wherein the steam set point is in the range of about 210–230° F.

4. A method for molding golf balls, according to claim 2, wherein the steam is applied for 25–30 minutes.

5. A method for molding golf balls, according to claim 2, wherein the maximum mold temperature is in the range of 230–280° F.

* * * * *